US011161726B2

(12) United States Patent
Wicklund et al.

(10) Patent No.: US 11,161,726 B2
(45) **Date of Patent: *Nov. 2, 2021**

(54) SAFETY DEVICE FOR MOBILE WORK PLATFORMS

(71) Applicant: Terex South Dakota, Inc., Watertown, SD (US)

(72) Inventors: Chad Wicklund, Redmond, WA (US); Dax Wells, Moses Lake, WA (US); Denis Korolev, Redmond, WA (US); Greg Hieronymus, Moses Lake, WA (US); Mitch Ely, Queensland (AU); Adam Hailey, Redmond, WA (US); Chad Hislop, Redmond, WA (US)

(73) Assignee: Terex South Dakota, Inc., Watertown, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/723,432

(22) Filed: Dec. 20, 2019

(65) Prior Publication Data

US 2020/0122990 A1 Apr. 23, 2020

Related U.S. Application Data

(63) Continuation of application No. 15/808,257, filed on Nov. 9, 2017, now Pat. No. 10,549,975.

(Continued)

(51) Int. Cl.
*B66F 11/04* (2006.01)
*B66F 17/00* (2006.01)

(52) U.S. Cl.
CPC ..... *B66F 17/006* (2013.01); *B66F 11/044* (2013.01)

(58) Field of Classification Search
CPC ..... B66F 17/006; B66F 11/04
See application file for complete search history.

(56) References Cited

U.S. PATENT DOCUMENTS 2,654,869 A 10/1953 Mudd, Jr.
3,521,216 A * 7/1970 Tolegian ..... H01R 13/6205 439/39

(Continued)

FOREIGN PATENT DOCUMENTS

CN 85101283 A 1/1987
CN 105339295 A 2/2016

(Continued)

OTHER PUBLICATIONS

Chinese Office Action for Application No. 201780070396.9, dated Oct. 14, 2020, 11 pages.

(Continued)

*Primary Examiner* — Alvin C Chin-Shue
(74) *Attorney, Agent, or Firm* — Brooks Kushman P.C.

(57) ABSTRACT

A land vehicle assembly is provided with a platform for an operator workspace. A control panel is supported upon the platform in electrical communication with the land vehicle. A caution switch is supported upon the platform in electrical communication with the control panel to provide a signal to the control panel indicative of a caution event. A cable is connected to the caution switch to extend across the control panel. The cable is spaced apart from the control panel so that a predetermined force upon the flexible member actuates the caution switch without significantly obstructing the control panel. A manual force upon the flexible member expands the operator workspace. The control panel is programmed to control a mobile operation of the land vehicle, and discontinue the mobile operation of the land vehicle in response to receipt of the caution event signal.

12 Claims, 6 Drawing Sheets

Related U.S. Application Data

(60) Provisional application No. 62/421,537, filed on Nov. 14, 2016.

(56) References Cited

U.S. PATENT DOCUMENTS

| | | | | |
|---|---|---|---|---|
| 3,921,530 | A * | 11/1975 | Burkhardt | F42C 11/007 102/219 |
| 4,554,420 | A | 11/1985 | Golub | |
| 9,586,799 | B2 | 3/2017 | Hao et al. | |
| 9,676,602 | B2 | 6/2017 | Cummings et al. | |
| 9,705,568 | B2 * | 7/2017 | Durm | G01D 21/00 |
| 2012/0160604 | A1 * | 6/2012 | Bowden | B66F 11/046 182/18 |
| 2012/0217091 | A1 | 8/2012 | Baillargeon et al. | |
| 2013/0233645 | A1 | 9/2013 | Hao et al. | |
| 2015/0008073 | A1 | 1/2015 | Cummings et al. | |
| 2016/0332856 | A1 * | 11/2016 | Steedley | B66F 11/044 |

FOREIGN PATENT DOCUMENTS

| | | | |
|---|---|---|---|
| CN | 105675036 | A | 6/2016 |
| WO | 2012001353 | A1 | 1/2012 |

OTHER PUBLICATIONS

English translation of Chinese Office Action for Application No. 201780070396.9, dated Mar. 17, 2020, 16 pages.

European Search Report and Written Opinion for Application No. 17868779.4, dated Jun. 3, 2020, 7 pages.

Chinese Office Action for Application No. 201780070396.9, dated Mar. 17, 2020, 13 pages.

International Search Report and Written Opinion for Application No. PCT/US17/61440, dated Jan. 12, 2018, 9 pages.

International Preliminary Report for Application No. PCT/US2017/061440, dated Jan. 16, 2019, 8 pages.

* cited by examiner

SAFETY DEVICE FOR MOBILE WORK PLATFORMS

CROSS-REFERENCE TO RELATED APPLICATIONS

This application is a continuation of U.S. application Ser. No. 15/808,257 filed Nov. 9, 2017, now U.S. Pat. No. 10,549,975 B2, which, in turn, claims the benefit of U.S. provisional application Ser. No. 62/421,537 filed Nov. 14, 2016, the disclosures of which are hereby incorporated in their entirety by reference herein.

TECHNICAL FIELD

Various embodiments relate to safety devices for mobile work platforms.

BACKGROUND

Hao et al. U.S. Patent Application Publication Number US 2013/0233645 A1, and Cummings et al. U.S. Patent Application Publication Number US 2015/0008073 A1 disclose safety devices for mobile work platforms.

SUMMARY

According to at least one embodiment, a mobile work platform assembly is provided with a platform adapted to be mounted to a vehicle. The platform is sized to receive an operator thereupon. A control panel is supported upon the platform. A caution switch is supported upon the platform. The caution switch is in electrical communication with the control panel to provide a signal to the control panel indicative of a caution event. A flexible member is connected to the caution switch to extend across the control panel and is spaced apart from the control panel so that a predetermined force upon the flexible member actuates the caution switch.

According to at least another embodiment, a land vehicle assembly is provided with a land vehicle. A mobile work platform assembly is provided with a platform adapted to be mounted to a vehicle. The platform is sized to receive an operator thereupon. A control panel is supported upon the platform. A caution switch is supported upon the platform. The caution switch is in electrical communication with the control panel to provide a signal to the control panel indicative of a caution event. A flexible member is connected to the caution switch to extend across the control panel and is spaced apart from the control panel so that a predetermined force upon the flexible member actuates the caution switch. The land vehicle supports the platform and is in electrical communication with the control panel. The control panel is programmed to control at least one mobile operation of the land vehicle, and discontinue the at least one mobile operation of the land vehicle in response to receipt of the caution event signal.

According to at least another embodiment, a method for selecting a caution mode of a mobile work platform provides a mobile work platform with a control panel. A caution switch is provided in communication with the control panel. A flexible member extends across the control panel and is connected to the caution switch. A mobile function of the mobile work platform is discontinued in response to receipt of a caution signal from the caution switch.

According to at least another embodiment, a mobile work platform assembly provides a platform adapted to be mounted to a vehicle. The platform is sized to receive an operator thereupon. A control panel is supported upon the platform. A caution switch is supported upon the platform in electrical communication with the control panel to provide a signal to the control panel indicative of a caution event. A barrier member is removably connected to the caution switch and the platform to extend across the control panel. The barrier member is spaced apart from the control panel so that a predetermined force upon the barrier member disconnects the barrier member from the platform and actuates the caution switch.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
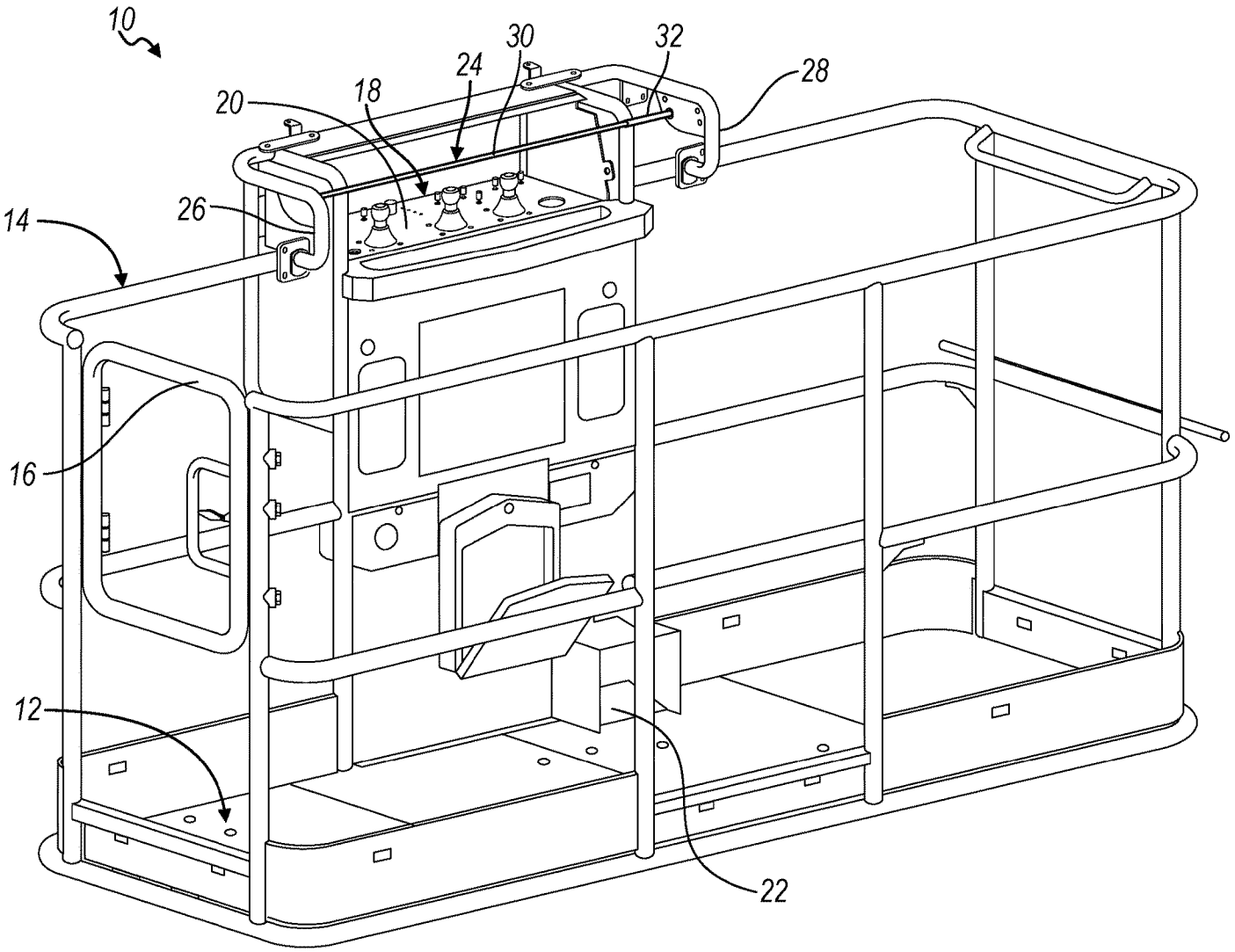
FIG. 1 is a front perspective view of a mobile work platform assembly according to an embodiment.

FIG. 1 illustrates a mobile work platform assembly referenced generally by numeral 10. The mobile work platform assembly 10 is adapted to be mounted to a land vehicle, such as an aerial lift, as is known in the art, and will be described further in a subsequent embodiment. The mobile work platform assembly 10 includes a platform 12 sized to receive an operator upon the platform 12. A frame assembly 14 is provided upon the platform 12. The frame assembly 14 provides a frame of guard rails that extend around a perimeter of the platform 12 to contain an operator within the frame assembly 14. A door 16 is provided upon the frame assembly 14 to permit operator ingress to, and egress from, the frame assembly 14.

Figure 2:
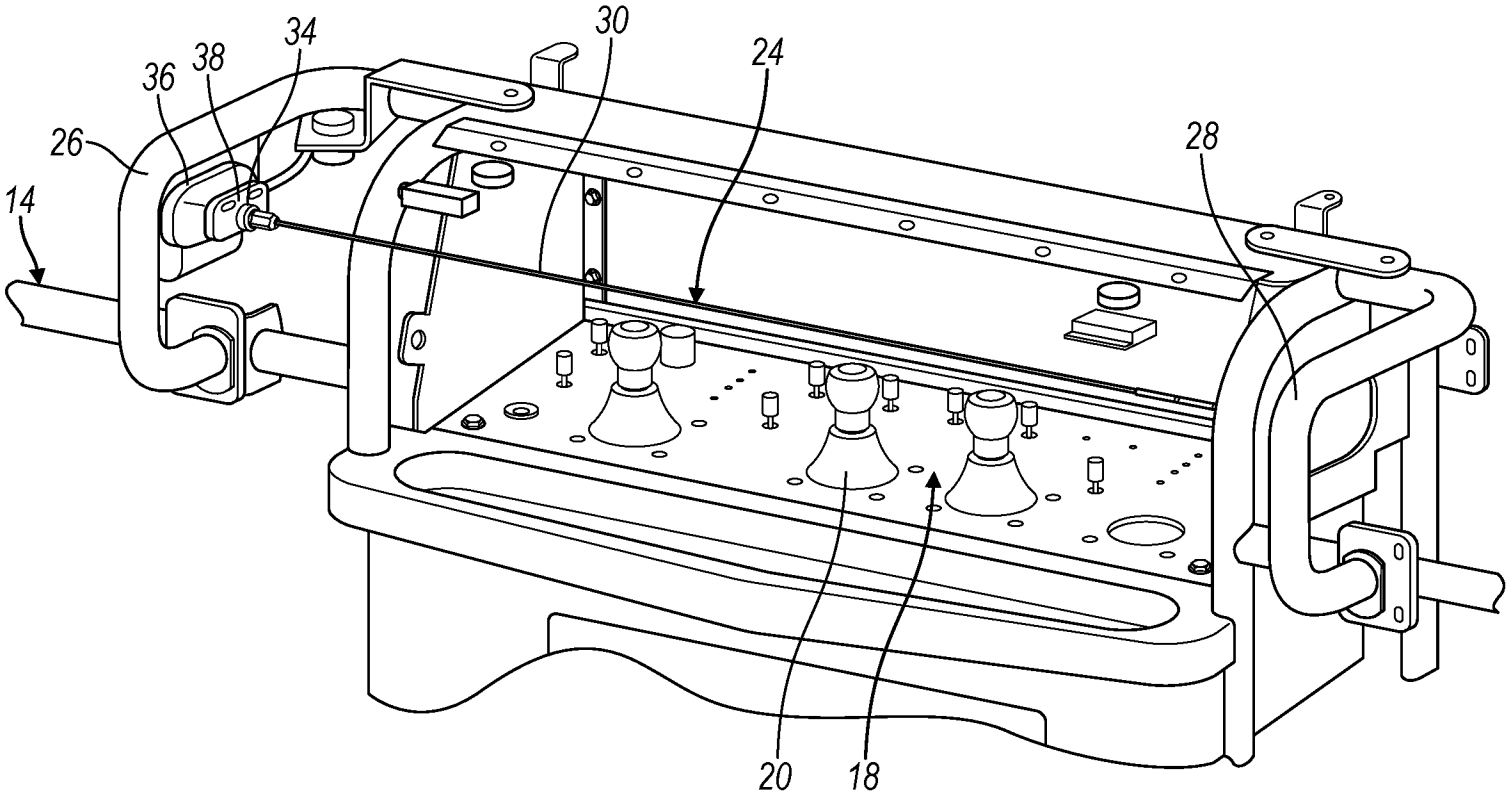
FIG. 2 is an enlarged front perspective view of a control panel of the mobile work platform assembly of FIG. 1.

Referring now to FIGS. 1 and 2, a control panel assembly 18 is provided upon the mobile work platform assembly 10. The control panel assembly 18 includes hand controls 20 and a foot switch 22. The foot switch 22 is labeled FS in the circuit diagram of FIG. 3. Referring back to FIGS. 1 and 2, the control panel assembly 18 is in communication with the associated land vehicle to control movement of the vehicle and the work platform assembly 10 relative to an underlying support surface. For example, the control panel assembly 18 may control transportation of the land vehicle upon the underlying support surface. The control panel assembly 18 may also control a lift mechanism for adjusting an elevation of the work platform assembly 10. The control panel assembly 18 permits the operator to move the work platform assembly 10 adjacent to an otherwise unreachable work region. The work platform assembly 10 provides a remote platform 12 for the operator to conduct work upon the associated work region.

The work platform assembly 10 includes a caution or safety device 24 to minimize involuntary operation of the control panel assembly 18, referred to as an operator protection system 24. During a work operation, an operator may inadvertently contact the control panel assembly 18. The safety device 24 minimizes involuntary operation of the control panel assembly 18 to minimize involuntary operation of the land vehicle and lift so that actuation of the safety device 24 disrupts control of the land vehicle and the lift.

Additionally, an operator may operate the control panel assembly 18 to move the work platform assembly 10 while overlooking or unaware of an obstacle. The operator protection system 24 protects the operator from being trapped between an external structure and the control panel assembly 18 by stopping the movement of the work platform assembly 10 once the caution device 24 is activated. This operator protection system 24 is a robust system that is unobtrusive, does not block the operator's view of the control panel assembly 18, and provides additional workspace upon the platform 12, once the operator protection system 24 is initiated.

The operator protection system 24 includes a pair of brackets 26, 28 that extend into from the frame assembly 14 into a workspace within the perimeter of the frame assembly 14. The operator protection system 24 includes a trigger cable 30 with a proximal end 32 (FIG. 1) that is connected to the right bracket 28. With reference now to FIG. 2, a magnet 34 is connected to a distal end of the cable 30. The magnet 34 affixes within a receptacle 36 on the left bracket 26. An inductive or proximity sensor 38 is provided in the receptacle 36 adjacent to the mounting surface of the magnet 34 to detect the presence of the magnet 34. Although, the pair of brackets 26, 28 are provided on the frame 14, the trigger cable 30 may be connected to any support structure on the work platform assembly 10.

Figure 3:
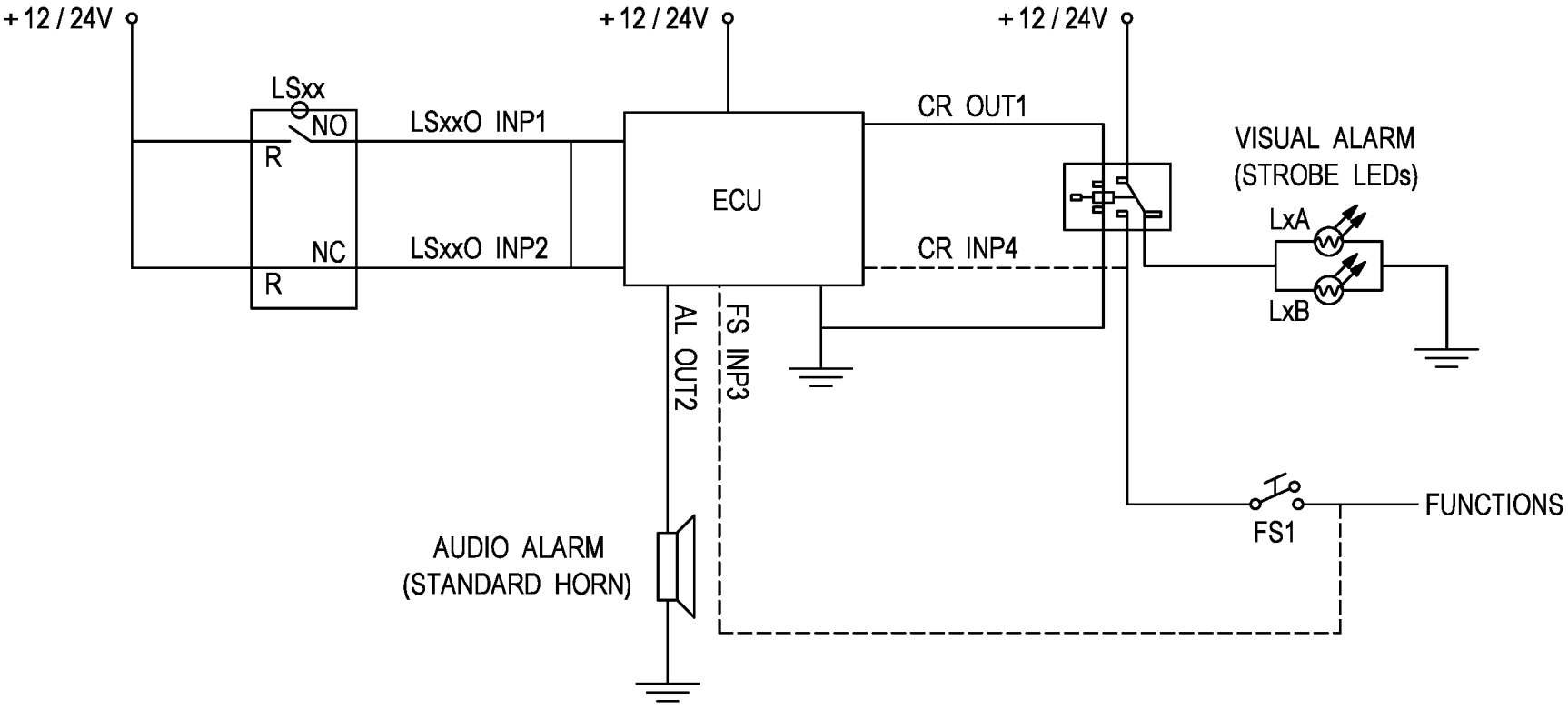
FIG. 3 is a circuit diagram of the control panel of the mobile work platform assembly of FIG. 1.

The cable 30 is attached at the distal end with the magnet 34 to a ferrous connection in the receptacle 36 of the left bracket 26. The proximal end 32 is attached to the right bracket 28 and pretensioned slightly so as to give some movement to the cable 30, yet dislodge the magnet 34 from the receptacle 36 once additional tension is applied to the cable 30. Referring now to FIGS. 1-3, the position of the magnet 34 is detected by the proximity switch 38, which is labeled LS for limit switch in the circuit diagram of FIG. 3. The limit switch LS, 38 is monitored by a processor or electronic control unit (ECU) in FIG. 3. When the trigger cable 30 is pushed upon, the cable 30 translates the magnet 34 away from a ferrous attachment in the receptacle 36. Removal of the magnet 34 activates the proximity switch 38.

In response to the activation of the proximity switch 38, the ECU initiates a caution or safety mode. In the caution mode, the ECU terminates movement of the work platform assembly 10 by stopping all motion of the land vehicle and the lift. The ECU also initiates an audio and visual alarm by initiating a horn (FIG. 3) and strobe light emitting diodes (LEDs) (also FIG. 3).

The prior art has offered machine controls that are mounted on a pivoting or movable mount that trips a switch once displaced from normal operating position. This prior art system requires the operator to be pressed into the controls to stop movement of the machine. This prior art system does not allow any additional space for the operator after the switch has been tripped. This prior art system may also create opportunities for the pivot/movable mount to become contaminated by debris or corrosion causing malfunctions and requiring maintenance and repair.

The prior art has also offered a pressure sensitive bar or switch mounted in front of the control panel. This prior art system requires the operator to be pressed into the pressure bar to stop movement of the machine. This prior art system does not provide additional space for the operator after the switch is tripped. The pressure sensitive bar is also within the workspace and may be accidentally tripped thereby creating nuisance mobility stoppages.

The prior art has also offered a pressure sensitive bar or switch mounted a distance above a leading edge of the controls on a breakaway mount. This prior art system requires the operator to be pressed into the pressure bar to stop movement of the machine. Due to the nature of the breakaway system, this prior art system is vulnerable to breakage in a construction environment. In addition, this prior art system creates an obstruction when viewing the operator controls.

Some prior art systems require an operator to replace parts that require tools for the replacement, in order to reset the system.

The operator protection system 24 provides simplicity over the prior art by providing a device that utilizes no moving switch contacts and allows the proximity switch 38 to be concealed in a protected location within the receptacle 36. The operator protector system 24 also provides enhanced visibility over the prior art. By utilizing the cable 30 to actuate the switch 38, visual obstructions of the control panel assembly 18 are minimized. Due to the visibility improvement, the operator protection system 24 allows the switch 38 to be located in an optimal position for actuation when needed, and creates additional workspace for the operator between the cable 30 and the control panel assembly 18 once the cable 30 has been disconnected from the receptacle 36. Although the cable 30 is illustrated and described, any suitable flexible member is contemplated, such as a chain, rope, or the like. Although one magnet 34 and sensor 38 is illustrated and described, any number of magnet connections with sensors may be employed. The operator protection system 24 is easily resettable, without requiring tools or replacement parts. For example, when the operator trips the protection system 24, but is not in danger, the operator can simply grab ahold of the magnet 34 and reinsert it into the receptacle 36, and the mobile work platform assembly 10 returns to normal operation.

Figure 4:
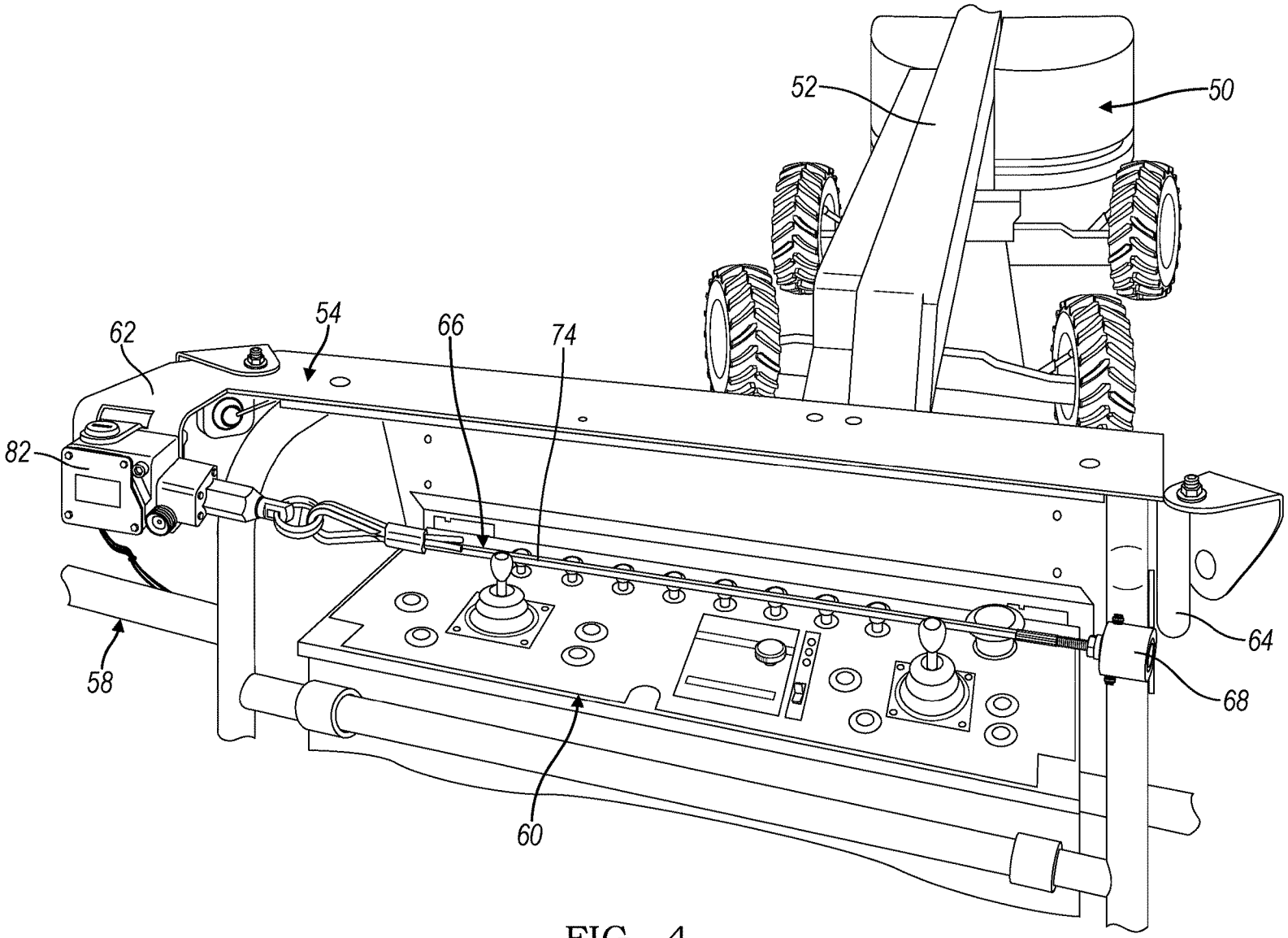
FIG. 4 is a front perspective view of mobile work platform assembly according to another embodiment.

FIG. 4 illustrates a land vehicle 50 according to an embodiment. The land vehicle 50 includes a lift arm 52, which supports a mobile work platform assembly 54 according to another embodiment. The mobile work platform assembly 54 is illustrated in FIGS. 4-7. The mobile work platform assembly 54 includes a platform 56 (FIG. 6), a frame assembly 58, and a control panel assembly 60.

Figure 6:
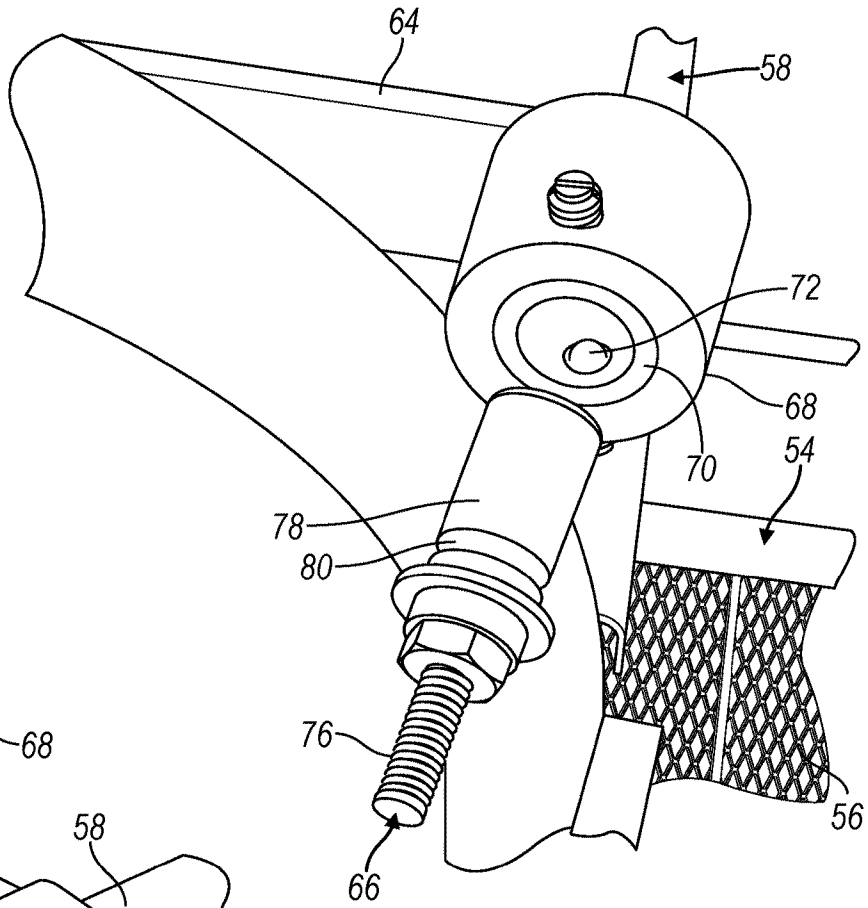
FIG. 6 is an enlarged side perspective view of the connector assembly of FIG. 5.
Figure 5:
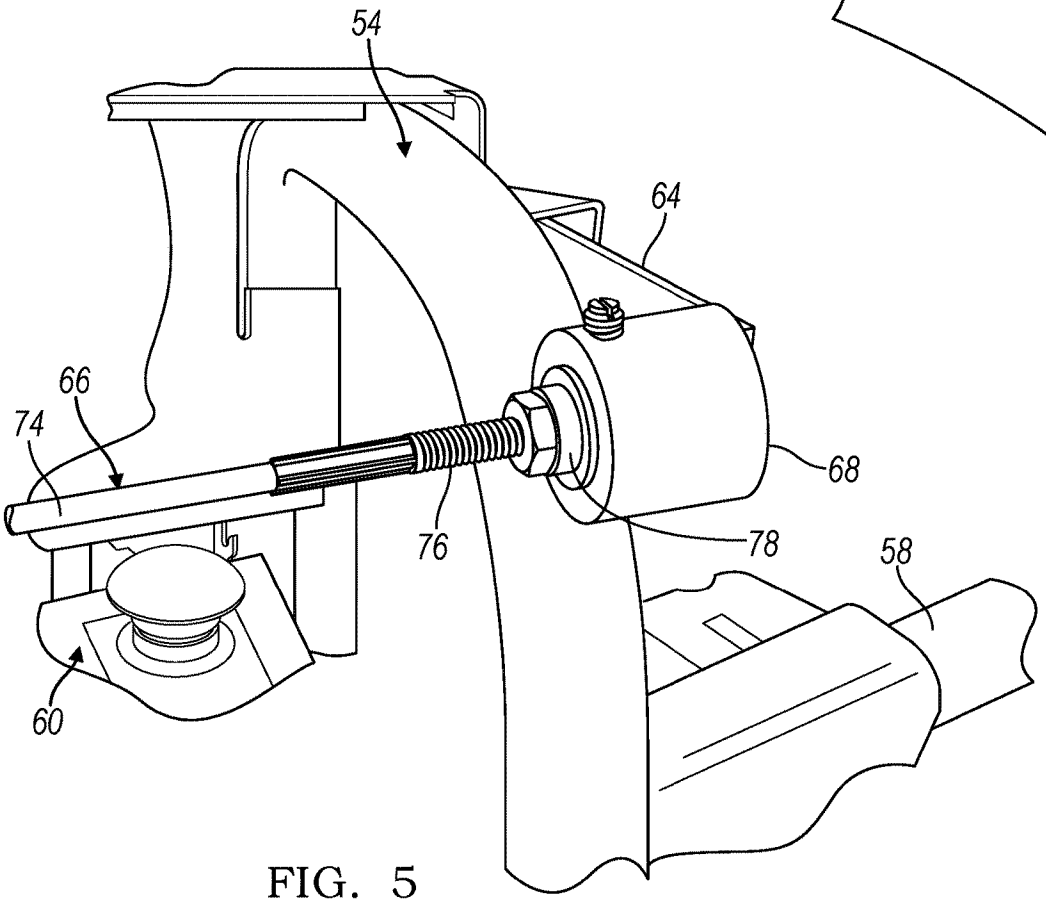
FIG. 5 is an enlarged front perspective view of a connector assembly of the mobile work platform assembly of FIG. 4.

A pair of brackets 62, 64 is mounted to the frame assembly 58. An operator protection system 66 is mounted to the pair of brackets 62, 64. With reference to FIGS. 4-6 a socket 68 is supported upon the right bracket 64. Referring specifically to FIG. 6, the socket 68 includes a bore 70 and a pair or spring-loaded ball bearings 72. Referring again to FIGS. 4-6, the operator protection system 66 includes a cable 74. A distal end of the cable 74 is provided with a threaded stud 76 for connection to a plug 78. The plug 78 is sized to be received in the socket 68. A groove 80 is formed in the plug 78 to receive the ball bearings 72 to retain the plug 78 in the socket 68. According to one embodiment, a limit switch is provided in the socket 68 to detect the presence of the plug 78.

Figure 7:
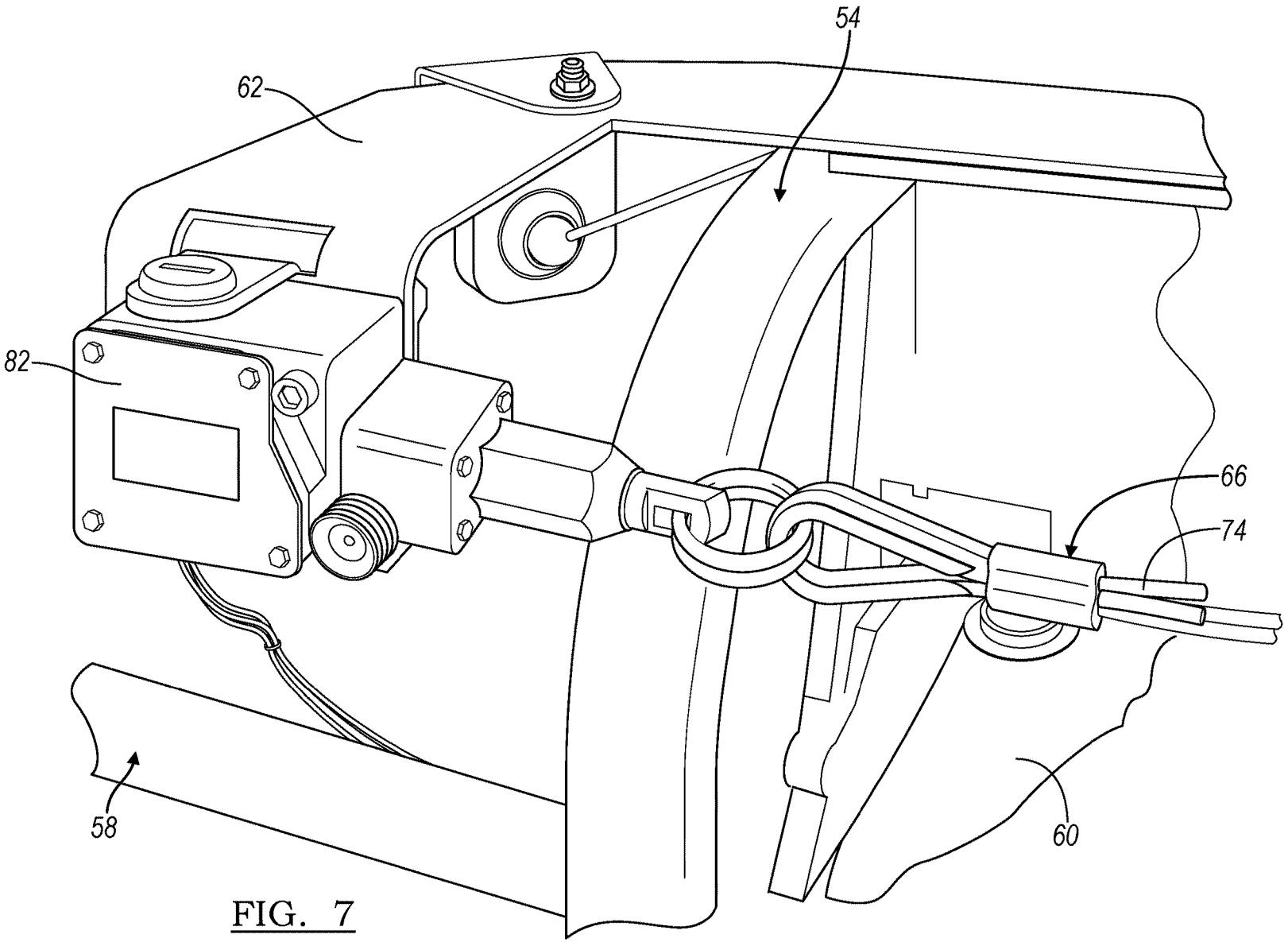
FIG. 7 is an enlarged front perspective view of another connector assembly of the mobile work platform assembly of FIG. 4.

Referring now to FIGS. 4 and 7, a limit switch 82 is provided on the left bracket 62. A proximal end of the cable 74 is connected to the limit switch 82. The cable 74 is tensioned so that the limit switch is freely maintained in a neutral position. At the neutral position, the control panel assembly 60 permits operation of the land vehicle 50 and lift arm 52. The tension of the cable 74 can be adjusted by the position of the plug 78 upon the threaded stud 76. If the cable 74 is pushed or pulled, the limit switch 82 is actuated, thereby informing the control panel assembly 60 of a caution event, whereby the control panel assembly 60 discontinues operation of the land vehicle 50 and lift arm 52 while providing a light and sound alarm. If the displacement of the cable 74 is more than a stroke of the limit switch 82, the plug 78 is removed from the socket 68, thereby dropping the cable 74 and providing additional workspace for the operator. The plug 78 and cable 74 have sufficient weight to keep the switch 82 in the caution position until reinstalled into the socket 68. Although one plug 78 and socket 68 connection is illustrated and described, both ends of the cable 74 may be connected with plug 78 and socket 68 connections, with limit switches in one or both sockets 68. Although a cable 74 is illustrated and described, any barrier member for manual disconnection from the frame assembly 58 may be employed. The operator protection system 66 is easily resettable, without requiring tools or replacement parts. For example, when the operator trips the protection system 66, but is not in danger, the operator can simply grab ahold of the plug 78 and reinsert it into the socket 70, and the mobile work platform assembly 10 returns to normal operation.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A mobile work platform assembly comprising:
- a platform adapted to be mounted to a vehicle, sized to receive an operator thereupon;
- a control panel supported upon the platform;
- a caution switch supported upon the platform;
- a flexible member associated with the caution switch to extend across the control panel and spaced apart from the control panel so that a predetermined force upon the flexible member actuates the caution switch; and
- a magnet connected to one of an end of the flexible member and the platform to attach the flexible member to the platform.

2. The mobile work platform assembly of claim 1 wherein the platform provides an operator workspace; and
- wherein a manual force upon the flexible member expands the operator workspace.

3. The mobile work platform assembly of claim 1 wherein the caution switch cooperates with the magnet to detect a presence and removal of the magnet from the platform.

4. The mobile work platform assembly of claim 1 wherein the magnet is connected to the end of the flexible member, and the platform is formed from a ferrous material to attach the magnet to the platform.

5. The mobile work platform assembly of claim 4 wherein a receptacle is formed into the platform, sized to receive the magnet.

6. The mobile work platform assembly of claim 5 wherein the caution switch comprises an inductive sensor oriented in the receptacle adjacent to a mounting surface of the magnet to detect a presence and removal of the magnet.

7. The mobile work platform assembly of claim 1 wherein the flexible member comprises a cable to minimize visual obstruction of the control panel.

8. The mobile work platform assembly of claim 7 wherein the cable is pretensioned to permit limited flexibility of the cable upon receipt of a force that is less than the predetermined force.

9. A land vehicle assembly comprising:
- a land vehicle; and
- a mobile work platform assembly according to claim 1; and
- wherein the land vehicle supports the platform and is in electrical communication with the control panel, wherein the control panel is programmed to:
  - control at least one mobile operation of the land vehicle, and
  - discontinue the at least one mobile operation of the land vehicle in response to receipt of a caution event signal from the caution switch.

10. The mobile work platform assembly of claim 1 further comprising an alarm supported upon the platform in electrical communication with the control panel, wherein the control panel is programmed to initiate the alarm in response to receipt of a caution event signal from the caution switch.

11. A mobile work platform assembly comprising:
- a platform adapted to be mounted to a vehicle, sized to receive an operator thereupon;
- a control panel supported upon the platform;
- a caution switch supported upon the platform in electrical communication with the control panel;
- a flexible barrier member associated with the caution switch, the flexible barrier member extending across the control panel and spaced apart from the control panel so that a predetermined force upon the flexible barrier member actuates the caution switch to indicate a caution event; and
- a magnet connected to one of an end of the flexible barrier member and the platform to attach the flexible barrier member to the platform.

12. A mobile work platform assembly comprising:
- a platform adapted to be mounted to a vehicle, sized to receive an operator thereupon;
- a control panel supported upon the platform;
- a caution switch supported upon the platform; and
- a barrier member removably connected to the caution switch and the platform to extend across the control panel and spaced apart from the control panel so that a predetermined force upon the barrier member disconnects the barrier member from the platform and actuates the caution switch; further comprising a magnet connected to one of an end of the barrier member and the platform to attach the barrier member to the platform.

* * * * *